United States Patent [19]

Duncan

[11] 4,020,595

[45] May 3, 1977

[54] DOOR OF ADJUSTABLE HEIGHT

[75] Inventor: James E. Duncan, New York, N.Y.

[73] Assignee: The Raymond Lee Organization, Inc., a part interest

[22] Filed: Mar. 17, 1976

[21] Appl. No.: 667,475

[52] U.S. Cl. ..... 49/306; 49/470; 49/480

[51] Int. Cl.[2] ..... E06B 7/20

[58] Field of Search ..... 49/303, 306, 470, 480; 52/122

[56] References Cited

UNITED STATES PATENTS

| | | | |
|---|---|---|---|
| 348,349 | 8/1886 | Schmidt | 49/306 |
| 839,213 | 12/1906 | Schwartz | 49/470 |
| 915,566 | 3/1909 | Dimick | 49/480 |
| 2,537,296 | 1/1951 | Yeakel | 49/306 |
| 3,871,133 | 3/1975 | Ellingson | 49/470 |

FOREIGN PATENTS OR APPLICATIONS

| | | | |
|---|---|---|---|
| 664,133 | 4/1929 | France | 49/306 |
| 633,872 | 2/1962 | Italy | 49/480 |

*Primary Examiner*—J. Karl Bell

[57] ABSTRACT

A flat, hollow, vertically elongated door panel has an open bottom. A movable piece is located inside the panel and can move up or down through the bottom. Horizontal bottom pieces are attached to the movable piece and both the bottom and movable pieces are spring-loaded downwardly.

1 Claim, 5 Drawing Figures

DOOR OF ADJUSTABLE HEIGHT

SUMMARY OF THE INVENTION

Frequently, doors are installed in a location where there is a bare floor, and the doors are mounted so as to open inwardly over the floor. If a rug is subsequently placed on the floor, the door cannot be easily opened without being planed down on the bottom. This causes a leakage of air underneath the door when it is closed, and also results in an unsightly appearance.

In this invention, a door is disclosed which has a movable piece that is always spring-loaded downwardly. When the door is closed, the piece is at its downwardmost position. If the door is opened over a rug or the like, the movable piece is forced up. Thus, the door can always be easily opened, and unsightly gaps between the doorjambs and the door are eliminated.

DETAILED DESCRIPTION OF PREFERRED EMBODIMENT

Figure 1:
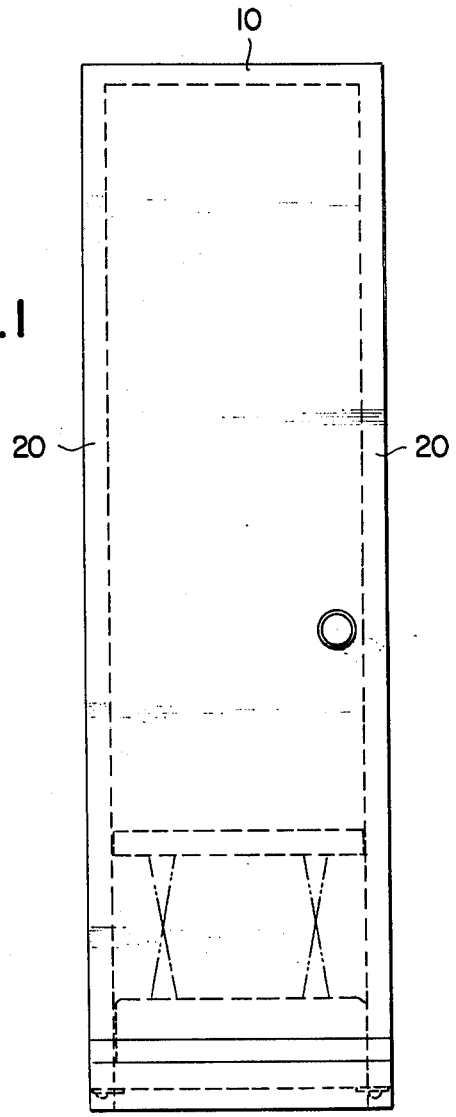
FIG. 1 is a front view of the invention.
Figure 2:
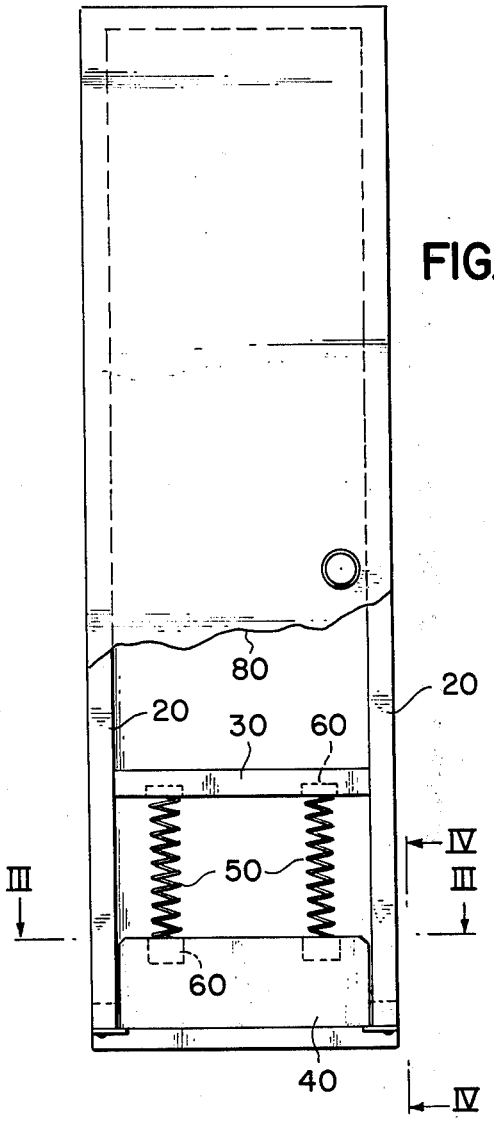
FIG. 2 is a front view of the invention, partially cut away to show construction details.
Figure 3:
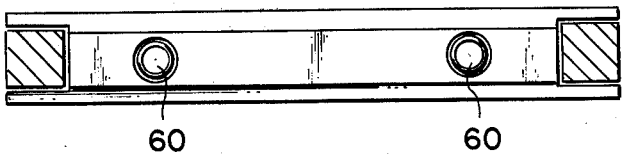
FIG. 3 is a view along line III—III on FIG. 2.
Figure 4:
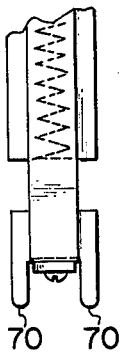
FIG. 4 is a view along line IV—IV on FIG. 2.
Figure 5:
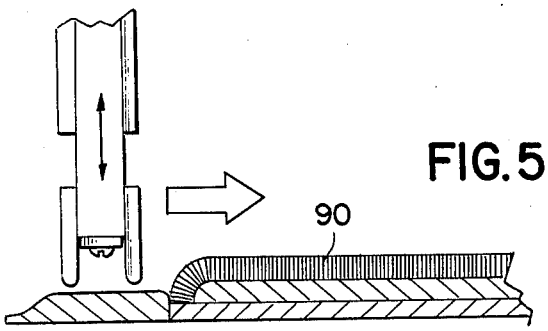
FIG. 5 shows how the invention operates in use.

A U-shaped frame is formed from a horizontal top piece 10 and two legs 20 that are attached to the ends of the top piece and that extend perpendicularly downwardly therefrom in a vertical plane. A horizontal elongated crosspiece 30 is located between the legs, near their lower ends.

A flat, rectangular movable piece 40 is located between the legs and move up and down between them in a vertical plane. Two parallel compression springs 50 are located in recesses 60 in pieces 30 and 40 and push the latter downwardly.

Two parallel, horizontally elongated bottom pieces 70 are each mounted on a corresponding side of piece 40, and move up and down with it. Additionally, two rectangular, vertically elongated panels 80 are secured to and lower corresponding sides of the frame. Each panel 80 is coplanar with a corresponding bottom piece. Thus, a hollow door is formed with the movable piece moving up and down in its open bottom. When the door is swung open over a carpet 90, the movable and bottom pieces are forced upwardly against the pressure of the springs.

I claim:

1. A door of adjustable height comprising:

A U-shaped vertical frame with a horizontal top piece and two like parallel vertical legs extending downwardly from the top piece;

a first horizontally extending cross piece coplanar with the frame and disposed between and secured to both legs adjacent but above the bottom ends of the legs;

a second cross piece disposed between the legs adjacent the bottom ends thereof and parallel to the first cross piece, the second cross piece being vertically movable up and down in the plane of the frame toward and away from the first cross piece;

first and second vertical parallel compression springs disposed within the frame between the first and second cross pieces, the springs being secured at upper ends to the first cross piece and at lower ends to the second cross piece;

first and second horizontally elongated bottom members secured to corresponding opposite sides of the second cross piece and extending therebelow; and first and second flat parallel vertical rectangular panels, each panel being coplanar with a corresponding one of the bottom members and covering the frame on a corresponding side.

* * * * *